US009144992B2

(12) United States Patent
Yamakawa

(10) Patent No.: US 9,144,992 B2
(45) Date of Patent: Sep. 29, 2015

(54) CARTRIDGE TYPE INK JET RECORDING APPARATUS

(71) Applicant: Keyence Corporation, Higashiyodogawa-ku, Osaka-shi (JP)

(72) Inventor: Hideki Yamakawa, Osaka (JP)

(73) Assignee: Keyence Corporation, Osaka (JP)

( * ) Notice: Subject to any disclaimer, the term of this patent is extended or adjusted under 35 U.S.C. 154(b) by 0 days.

(21) Appl. No.: 14/559,940

(22) Filed: Dec. 4, 2014

(65) Prior Publication Data

US 2015/0197096 A1 Jul. 16, 2015

(30) Foreign Application Priority Data

Jan. 16, 2014 (JP) ..... 2014-006196

(51) Int. Cl.
*B41J 2/175* (2006.01)

(52) U.S. Cl.
CPC ..... *B41J 2/17566* (2013.01); *B41J 2/17596* (2013.01); *B41J 2002/17573* (2013.01)

(58) Field of Classification Search
CPC .... B41J 2/175; B41J 2/17566; B41J 2/17596; B41J 2002/17573
USPC ..... 347/7
See application file for complete search history.

(56) References Cited

U.S. PATENT DOCUMENTS 4,884,065 A * 11/1989 Crouse et al. ..... 340/632
8,534,791 B2 * 9/2013 Takata et al. ..... 347/19

FOREIGN PATENT DOCUMENTS

JP 2007-190724 8/2007
JP 2011-500353 1/2011
WO 2009/047497 A2 4/2009
WO WO 2011076810 A1 * 6/2011

* cited by examiner

*Primary Examiner* — Alessandro Amari
*Assistant Examiner* — Michael Konczal
(74) *Attorney, Agent, or Firm* — Kilyk & Bowersox, P.L.L.C.

(57) ABSTRACT

An object is to directly detect the emptiness of a solvent cartridge being mounted. An emptiness detection unit body includes a light transmissive tube which constitutes part of internal piping of a printer body, a light emitter, and a light receiver. The light transmissive tube is composed of a transparent tube, typically, a glass tube or a fluororesin (PFA) tube. The light emitter and the light receiver are arranged to face the light transmissive tube. The light transmissive tube is filled with a solvent supplied from the solvent cartridge. On the other hand, the light transmissive tube is filled with gas when the solvent cartridge is empty. The emptiness of the solvent cartridge is detected by a change in the amount of light received by the light receiver associated with the change in the light transmissive tube.

10 Claims, 12 Drawing Sheets

CARTRIDGE TYPE INK JET RECORDING APPARATUS

CROSS-REFERENCE TO RELATED APPLICATIONS

The present application claims foreign priority based on Japanese Patent Application No. 2014-006196, filed Jan. 16, 2014, the contents of which is incorporated herein by reference.

BACKGROUND OF THE INVENTION

1. Field of the Invention

The present invention relates to a continuous type ink jet recording apparatus which adjusts the viscosity of an ink liquid using a solvent supplied from a solvent cartridge, and more specifically to an ink jet recording apparatus having a function of detecting the emptiness of the solvent cartridge.

2. Description of Related Art

An ink jet recording apparatus is used for printing characters or graphics on the surface of a workpiece (JP 2007-190724 A). The ink jet recording apparatus is generally called "ink jet printer". The ink jet printer includes a head which is placed above a manufacturing line and a controller body which supplies ink to the head. The ink jet printer charges an ink liquid and forms the ink liquid into droplets, and deflects the ink droplets to thereby perform printing on the surface of a workpiece.

In the ink jet recording apparatus disclosed in JP 2007-190724 A, the ink liquid is continuously supplied to the head even when ink droplets are not printed on a workpiece and the supplied ink liquid is collected through a gutter as an ink receiver. That is, the ink jet recording apparatus disclosed in JP 2007-190724 A is a continuous type ink jet printer.

As a method for replenishing an ink jet recording apparatus with an ink or solvent, there are employed many methods in which a reserve tank is installed in an ink jet recording apparatus (JP 2007-190724 A). However, in the methods in which a reserve tank is installed in an ink jet recording apparatus, filling the reserve tank with ink may cause contamination of the surroundings of the reserve tank. In view of such a circumstance, an ink jet recording apparatus that employs a cartridge system using a cartridge which can be attached to and detached from the ink jet recording apparatus has come to be available (JP 2011-500353 W).

When the cartridge system is employed, there may be employed a system which maintains the internal pressure of a cartridge at atmospheric pressure when sucking out a liquid inside the cartridge by a pump, or a negative pressure system which sucks out a liquid from a cartridge in a sealed state. JP 2011-500353 W employs the latter system, that is, the system which sucks out a liquid from a cartridge in a sealed state. In the negative pressure system, the internal pressure of the cartridge becomes a negative pressure by sucking out the liquid from the cartridge.

When the cartridge system is employed, it is necessary to detect that a cartridge mounted therein has become empty in order to perform accurate cartridge replacement. In order to achieve this object, an ink jet printer disclosed in JP 2011-500353 W includes a pump which is placed inside a main body thereof, that is, a pump for sucking out a liquid inside a cartridge. A pressure sensor which is placed on a tube path between the pump and the cartridge detects whether the cartridge has become empty.

According to the description in JP 2011-500353 W, when the volume of the cartridge becomes almost zero, the pressure in the tube path rapidly decreases. It is possible to confirm that the cartridge has become empty using this phenomenon.

When employing, for example, the method disclosed in JP 2011-500353 W, that is, the method which measures the pressure in the tube path which communicates with the cartridge as means for confirming the emptiness of the cartridge, the pressure in the tube path and the remaining amount in the cartridge therefore do not necessarily correspond to each other because the method is an indirect method. A container for storing liquid, the container constituting the cartridge, is crushed by suction performed by the pump and the volume thereof is reduced (volume reduction). The degree of crushability has an individual difference between containers more or less. Further, the pressure in the tube path changes depending on the individual difference. This fact shows that although the method of JP 2011-500353 W is effective to confirm that the cartridge has become almost empty, it is virtually not possible to more accurately detect that the cartridge has actually become empty.

SUMMARY OF THE INVENTION

An object of the present invention is to provide an ink jet recording apparatus provided with a solvent cartridge, specifically, an ink jet recording apparatus capable of directly detecting the emptiness of the solvent cartridge mounted therein.

According to one embodiment of the present invention, the above technical object is achieved by providing an ink jet recording apparatus, the ink jet recording apparatus being a continuous type ink jet recording apparatus that has a reservoir detachably receiving a solvent cartridge and adjusts the viscosity of an ink liquid by replenishment with a solvent from the solvent cartridge, the ink jet recording apparatus including:

a main tank storing an ink liquid therein;

a solvent flowing tube connected to the reservoir, the solvent flowing tube allowing a solvent in the solvent cartridge attached to the reservoir to flow therethrough;

a pump for sucking the solvent in the solvent cartridge attached to the reservoir to supply the sucked solvent to the main tank through the solvent flowing tube; and an optical emptiness detection mechanism disposed on the middle of a path of the solvent flowing tube, the optical emptiness detection mechanism including a light transmissive tube communicating with the solvent flowing tube, a light emitter arranged to face the light transmissive tube, the light emitter for emitting light toward the light transmissive tube, and a light receiver for receiving light reflected by the light transmissive tube or light passing through the light transmissive tube and outputting a signal on the basis of the amount of the received light, wherein emptiness detection for the solvent cartridge attached to the reservoir is performed on the basis of the signal output from the light receiver.

According to a preferred embodiment of the present invention, the solvent cartridge is deformed to reduce the volume thereof in response to a decrease in the amount of solvent remaining therein. Gas is previously enclosed inside the solvent cartridge. When the amount of solvent remaining inside the solvent cartridge becomes zero, air enters the light transmissive tube. An optical path of light emitted from the light emitter changes between when the solvent is present inside the light transmissive tube and when air is present inside the light transmissive tube. This change leads to a change in the amount of light received by the light receiver. Therefore, it is possible to detect the emptiness of the solvent cartridge by the change in the amount of light received by the light receiver.

As one typical arrangement example, the light emitter and the light receiver are arranged so that light emitted from the light emitter is received by the light receiver when the solvent is present inside the light transmissive tube. As another typical arrangement example, the light emitter and the light receiver are arranged so that light emitted from the light emitter is received by the light receiver when gas is present inside the light transmissive tube.

The effects and other objects of the present invention will become apparent from the following detailed description of the preferred embodiment of the present invention.

BRIEF DESCRIPTION OF THE DRAWINGS

FIGS. 10A and 10B are diagrams for explaining one aspect of optically detecting the emptiness of the solvent cartridge, wherein FIG. 10A illustrates a state in which the light transmissive tube is filled with air and FIG. 10B illustrates a state in which the light transmissive tube is filled with a solvent;

FIGS. 11A and 11B are diagrams for explaining another aspect of optically detecting the emptiness of the solvent cartridge, wherein FIG. 11A illustrates a state in which the light transmissive tube is filled with air and FIG. 11B illustrates a state in which the light transmissive tube is filled with a solvent;

FIGS. 12A and 12B are diagrams for explaining still another aspect of optically detecting the emptiness of the solvent cartridge, wherein FIG. 12A illustrates a state in which the light transmissive tube is filled with air and FIG. 12B illustrates a state in which the light transmissive tube is filled with a solvent;

DETAILED DESCRIPTION OF PREFERRED EMBODIMENT

Embodiment

Hereinbelow, a preferred embodiment of the present invention will be described with reference to the accompanying drawings.

Figure 1:
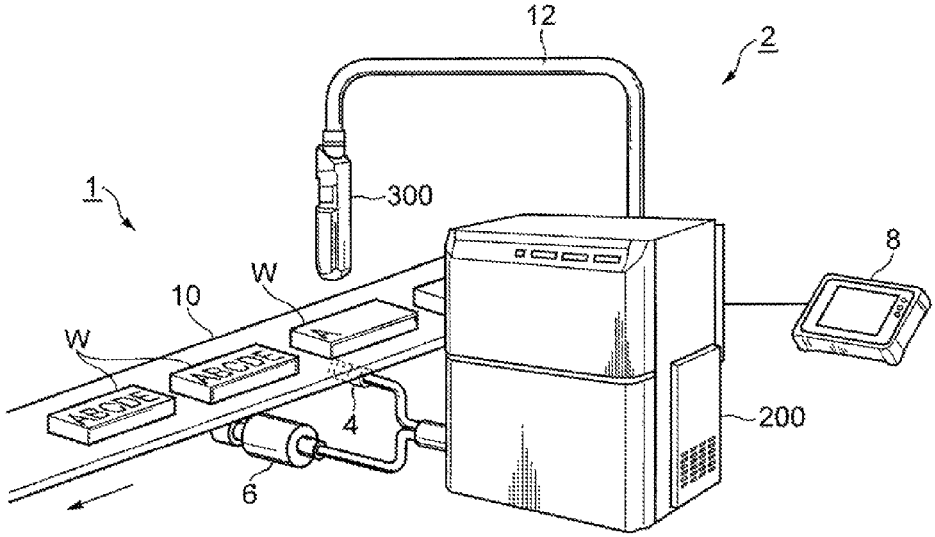
FIG. 1 is a diagram illustrating the entire configuration of an automatic printing system which includes a cartridge type ink jet printer of an embodiment.

Automatic Printing System and Ink Jet Printer:

FIG. 1 is a diagram illustrating the outline of an example of an automatic printing system which includes a cartridge type ink jet recording apparatus. The illustrated automatic printing system 1 includes an ink jet recording apparatus 2 of the embodiment, a workpiece detection sensor 4, a conveyance speed sensor 6, a display device 8, and the like.

The ink jet recording apparatus 2 is generally called "ink jet printer". Therefore, the ink jet recording apparatus 2 will be described using the term "ink jet printer". The ink jet printer 2 is a continuous type printer which continuously jets ink. The ink jet printer 2 of the embodiment is installed in a workpiece conveyance line 10 and used for printing characters or graphics on a workpiece W flowing on the workpiece conveyance line 10. The workpiece W as a printing target is, for example, an electronic component, a plastic bag, or the like. The workpiece detection sensor 4 detects the presence/absence of the workpiece W and outputs a trigger for starting printing. Upon receiving the trigger signal, printing on the workpiece W is started.

The ink jet printer 2 includes a printer body 200 which is installed near the workpiece conveyance line 10 and a head 300 which is placed above the workpiece conveyance line 10. The printer body 200 and the head 300 are connected to each other through a flexible hose 12. A quick-drying ink liquid is circulated between the printer body 200 and the head 300. The head 300 performs dot printing on workpieces W which are conveyed one after another. An arrow in FIG. 1 indicates a conveyance direction of the workpiece W.

Figure 2:
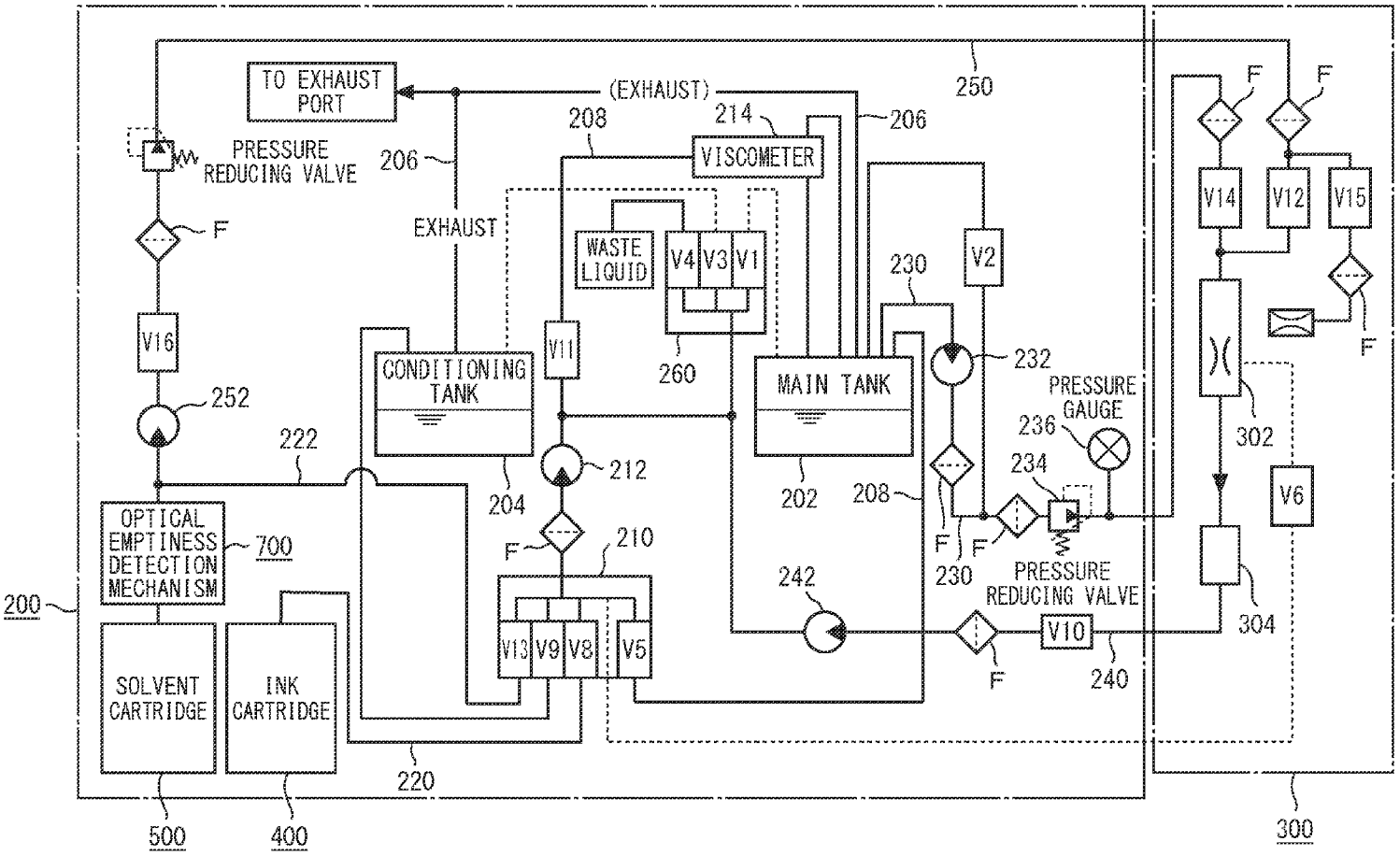
FIG. 2 is a diagram illustrating the entire configuration of the ink jet printer.

Circuit Configuration (FIG. 2):

FIG. 2 is a circuit diagram of a liquid flow in the cartridge type ink jet printer 2. The outline thereof will be described with reference to FIG. 2. The printer body 200 includes a main tank 202 and a conditioning tank 204. Gas inside the main tank 202 and the conditioning tank 204 is discharged into the atmosphere through an exhaust tube 206.

An ink liquid inside the main tank 202 is circulated through an ink circulation tube 208. In the ink circulation tube 208, a main path switching valve 210, a circulation pump 212, and the like are disposed in this order in an ink liquid flowing direction. The ink liquid inside the main tank 202 is circulated through the ink circulation tube 208 by the circulation pump 212. In FIG. 2, F denotes a filter. Further, V1, and V3 to V6 denote diaphragm type solenoid valves.

A viscometer 214 which takes in part of the ink liquid flowing through the ink circulation tube 208 to detect the viscosity of the ink liquid is disposed on the ink circulation tube 208. The concentration of the ink liquid inside the main tank 202 is monitored using the viscosity detected by the viscometer 214.

Replenishment of the main tank 202 with an ink liquid is performed using an ink cartridge 400. The ink cartridge 400 is connected to the main path switching valve 210 through an ink replenishment tube 220. An ink inside the ink cartridge 400 is supplied to the main tank 202 by controlling the main path switching valve 210.

Replenishment of the main tank 202 with a solvent is performed using a solvent cartridge 500. A solvent for maintaining the viscosity of the ink liquid constant, for example, methyl ethyl ketone (MEK) is stored in the solvent cartridge 500.

The printer body 200 has an optical emptiness detection mechanism 700 located near the solvent cartridge 500. The optical emptiness detection mechanism 700 will be described in detail later. In the illustrated example, the solvent cartridge 500 is connected to the main path switching valve 210 through the optical emptiness detection mechanism 700 and a solvent replenishment tube 222 which is "solvent flowing tube". The solvent inside the solvent cartridge 500 is supplied to the main tank 202 by controlling the main path switching valve 210, and the concentration of the ink inside the main tank 202 is adjusted using the supplied solvent. Specifically, the concentration of the ink inside the main tank 202 is detected by the viscometer 214 while circulating the ink through the ink circulation tube 208, and a solvent of an amount corresponding to the detected concentration is supplied to the main tank 202 from the solvent cartridge 500 to thereby perform the adjustment of the concentration of the ink inside the main tank 202.

The main tank 202 is connected to the head 300 through an ink supply tube 230. An ink pump 232 is disposed on the ink supply tube 230. The ink inside the main tank 202 is supplied to the head 300 by the ink pump 232.

As is well known, the head 300 is provided with mechanism components 302 such as a cannon (pressurizer), a piezoelectric element, a nozzle, a charging electrode, and a deflection electrode. The mechanism components 302 deflect an impact position of charged ion particles to thereby perform printing on the workpiece W.

In the ink supply tube 230, a pressure reducing valve 234 and a pressure gauge 236 are disposed in this order in an ink flowing direction on the downstream side with respect to the ink pump 232. The discharge pressure of the ink pump 232 is adjusted based on the pressure detected by the pressure gauge 236.

The head 300 has a gutter 304 for receiving ink droplets. The gutter 304 is connected to the main tank 202 through an ink collection tube 240. A gutter pump 242 is disposed on the ink collection tube 240. The ink received in the gutter 304 is collected into the printer body 200 by the gutter pump 242.

In the illustrated example, the solvent cartridge 500 is connected to the head 300 through the optical emptiness detection mechanism 700 and a head cleaning tube 250 which is the "solvent flowing tube". A cleaning pump 252 is disposed on the head cleaning tube 250. As a modification, the optical emptiness detection mechanism 700 may be disposed on the downstream side with respect to the cleaning pump 252.

When starting and stopping the ink jet printer 2, a solvent is supplied to the head 300 from the solvent cartridge 500. The components in the head 300 such as the nozzle, the charging electrode, and the deflection electrode are cleaned with the supplied solvent. The solvent that has been used for the cleaning is received in the gutter 304, and then collected into the printer body 200 through the ink collection tube 240.

The ink or solvent received in the gutter 304 is collected into the main tank 202 or the conditioning tank 204 by a second path switching valve 260 disposed on the ink collection tube 240. The collected solvent is stored in the conditioning tank 204. The solvent in the conditioning tank 204 is supplied to the main tank 202 in preference to the solvent inside the solvent cartridge 500 and used for controlling the concentration of ink.

JP 2007-190724 A describes, in detail, circulation of the ink liquid between the printer body 200 and the head 300, replenishment of the main tank 202 with the solvent, that is, adjustment of the viscosity of the ink liquid inside the main tank 202, circulation of the ink liquid inside the main tank 202, the configuration of the head 300, and details of a circuit of the printer body 200. Therefore, more detailed description will be omitted by incorporating the description in JP 2007-190724 A in the present specification.

Figure 3:
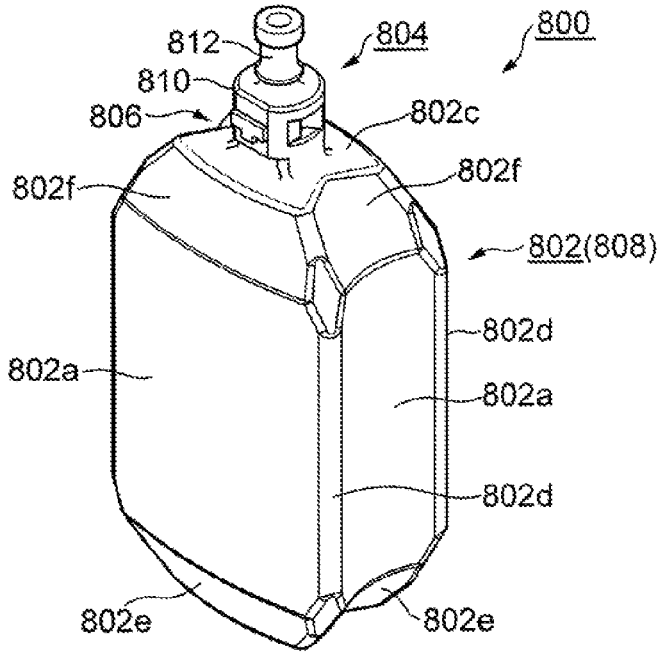
FIG. 3 is a perspective view of a bottle which constitutes a container body of an ink cartridge or a solvent cartridge.
Figure 6:
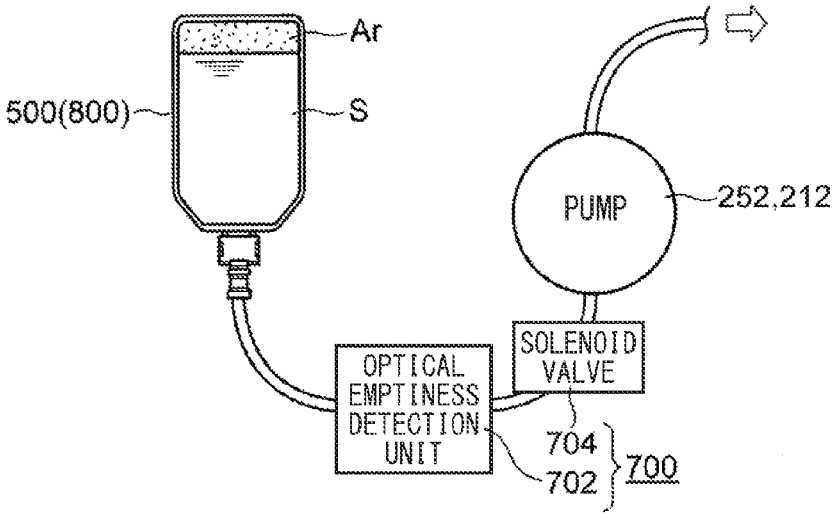
FIG. 6 is a diagram for explaining the basic configuration of an optical emptiness detection mechanism for detecting the emptiness of the solvent cartridge.

Bottle of Ink Cartridge 400 and Solvent Cartridge 500 (FIG. 3):

FIG. 3 illustrates a bottle 800 which constitutes a container portion of each of the ink cartridge 400 and the solvent cartridge 500. The bottle 800 is a molded article made of a synthetic resin. The bottle 800 includes a bottomed bottle body 802 and a projecting portion 804 which projects in the axial direction from the central part of one end face of the bottle body 802. In the description of the bottle 800, the bottle 800 is in a standing state with the projecting portion 804 facing upward as illustrated. It is needless to say that the bottle 800 is attached to the printer body 200 with the projecting portion 804 facing downward, for example, by vertically inverting the state as illustrated in FIG. 6.

The bottle body 802 has four side faces 802*a*, a bottom face (not illustrated for drawing reasons), and a top face 802*c*. The projecting portion 804 is positioned on the central part of the top face 802*c*. The bottle body 802 further has four side corner portions 802*d* each having a shape chamfering a part between adjacent side faces 802*a*, 802*a*. Further, the bottom face is connected to the lower end of each of the side faces 802*a* and the lower end of each of the side corner portions 802*d* with a bottom inclined face 802*e* interposed therebetween. Similarly, the top face 802*c* is connected to the upper end of each of the side faces 802*a* and the upper end of each of the side corner portions 802*d* with an upper inclined face 802*f* interposed therebetween.

When a liquid (ink or solvent) which is a content of the bottle 800 is sucked out of the bottle 800, the bottle 800 is crushed to reduce the volume thereof in response to the suction. The central part of the top face 802*c* and the projecting portion 804 of the bottle 800 constitute a rigid portion 806 which is resistant to deformation. On the other hand, the bottle body 802 excepting the central part of the top face 802*c* constitutes a volume reduction portion 808 which deforms corresponding to a decrease of the liquid as the content so that the volume of the bottle body 802 decreases in response to the decrease of the content.

In the embodiment, the side faces 802*a* and the side corner portions 802*d* are thin. On the other hand, the upper inclined faces 802*f*, the bottom inclined faces 802*e*, and the bottom face 802*b* are relatively thick. As will be described later, when the bottle 800 is formed by blow molding, the wall thickness of the bottle 800 is gradually reduced toward the far side from an axis line passing through the center of the mouth 812 of the bottle 800. Therefore, the side corner portions 802*d* which are located farthest from the axis line are made thin. The bottle body 802 is designed so that the dimension in the height direction hardly varies and the volume thereof is reduced by a decrease in the dimension in the width direction by adjusting the thickness. That is, the bottle body 802 is designed so as to be made smaller in the width direction in a defined form by adjusting the thickness of the upper inclined faces 802*f* and the bottom inclined faces 802*e*. It is needless to say that the volume reduction portion 808 of the bottle body 802 may be made of an aluminum pouch or a thin flexible resin material and covered with a relatively hard outer cover which is composed of, for example, a synthetic resin molded article.

The projecting portion 804 which projects in the axial direction from a central part of the top face 802*c* of the bottle body 802 includes a neck 810 which expands after slightly extending upward from the bottle top face 802*c* and has a relatively large diameter and the mouth 812 which extends upward from the upper end of the neck 810 and has a relatively small diameter. A rubber stopper (reference numeral 814 in FIG. 4) is inserted into the mouth 812 after filling the bottle 800 with the content to thereby seal the bottle 800.

Figure 4:
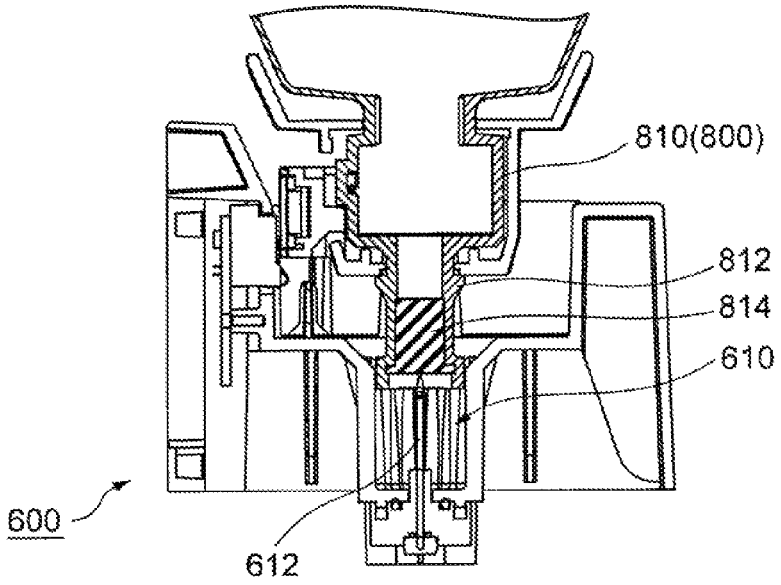
FIG. 4 is a cross-sectional view for explaining a central deep part of a reservoir which is placed on a printer body for receiving the cartridge.
Figure 5:
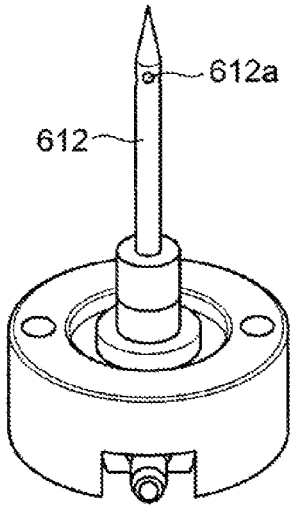
FIG. 5 is a diagram illustrating a hollow needle which is placed on the reservoir.

Reservoir 600 (FIGS. 4 and 5):

The printer body 200 is provided with a reservoir 600 for detachably receiving the ink cartridge 400 or the solvent cartridge 500. The reservoir 600 has a recess 610 which closely receives the mouth 812 of the bottle 800 (hereinbelow, also referred to as "bottle mouth 812"). A hollow needle 612 stands on the center of the bottom of the recess 610 (FIG. 4). The bottle mouth 812 is closely fitted into the recess 610, so that the bottle 800 is held by the recess 610 of the reservoir 600. The hollow needle 612 penetrates a rubber stopper 814 which closely closes the bottle mouth 812 and the tip part of the hollow needle 612 is exposed inside the bottle 800. As can be seen from FIG. 5, the hollow needle 612 has an opening 612*a* formed on the tip part thereof. Liquid inside the bottle 800 is sucked out through the opening 612*a*.

Optical Emptiness Detection Mechanism 700 (FIGS. 6 to 12(B)):

First, a method for detecting the emptiness of the ink cartridge 400 will be simply described. For example, there is a method (method 1) using the conductivity of ink by disposing an electrode on a path through which the ink flows. Specifically, when a single or a plurality of electrodes are disposed on an ink supply path, a signal obtained from the electrode(s) changes depending on the presence or absence of a conductive ink. On the basis of the change in the signal, the presence/absence of ink in the ink flow path is detected. When there is no ink in the ink flow path even when driving the pump for a predetermined time, it is possible to determine that the ink cartridge 400 has become empty. Also, for example, there is another method (method 2) in which a liquid level gauge is provided in the main tank. Specifically, when an increase in the amount of ink inside the main tank is not detected by the liquid level gauge even when driving the ink supply pump for a predetermined time (when time-out occurs), it is possible to determine that the ink cartridge 400 has become empty. As described above, there are several methods for detecting the emptiness of the ink cartridge 400.

However, it is not easy to detect the emptiness of the solvent cartridge 500 compared to the case of the ink cartridge 400. For example, the above method 1 cannot be used because the solvent does not have conductivity unlike ink in most cases. Further, the above method 2 also cannot be used. This is because that the solvent sucked out of the solvent cartridge 500 may be supplied to (stored in) the conditioning tank 204 in addition to the main tank 202, and the amount of solvent inside the main tank therefore does not always increase by driving the pump.

In addition, for example, when the amount of solvent taken out of the solvent cartridge 500 per unit time is known, it is possible to estimate, to some extent, the amount of a used solvent by measuring driving time of the pump (the amount of the used solvent=the amount of suction per unit time×the pump driving time). However, although this method is preferred for merely checking the amount of solvent remaining inside the solvent cartridge 500, it is difficult to more accurately determine whether the solvent cartridge 500 has become empty.

Therefore, the ink jet printer 2 according to the present embodiment is equipped with the optical emptiness detection mechanism 700. Accordingly, it is possible to more accurately detect the emptiness of the solvent cartridge 500. Hereinbelow, the optical emptiness detection mechanism 700 will be described in detail with reference to the drawings.

FIGS. 6 to 12(B) are diagrams for explaining the optical emptiness detection mechanism 700. FIG. 6 is a diagram for explaining a position where the optical emptiness detection mechanism 700 is disposed. Referring to FIG. 6, a solvent S inside the solvent cartridge 500 is sucked out by the circulation pump 212 or the cleaning pump 252 as describe above with reference to FIG. 2. The solvent cartridge 500 is maintained in a sealed state. Therefore, the bottle 800 of the solvent cartridge 500 is crushed to reduce the volume thereof (volume reduction) in response to the suction performed by the circulation pump 212 or the cleaning pump 252. In the process of manufacturing the solvent cartridge 500, the amount of the solvent S that fills the bottle 800 is defined so that a predetermined amount of gas, typically, air Ar is present inside the bottle 800 after sealing the bottle 800 filled with the solvent S using the rubber stopper 814 (FIG. 4). The optical emptiness detection mechanism 700 includes an optical emptiness detection unit 702 and, preferably, a solenoid on-off valve (a solenoid valve) 704.

Figure 7:
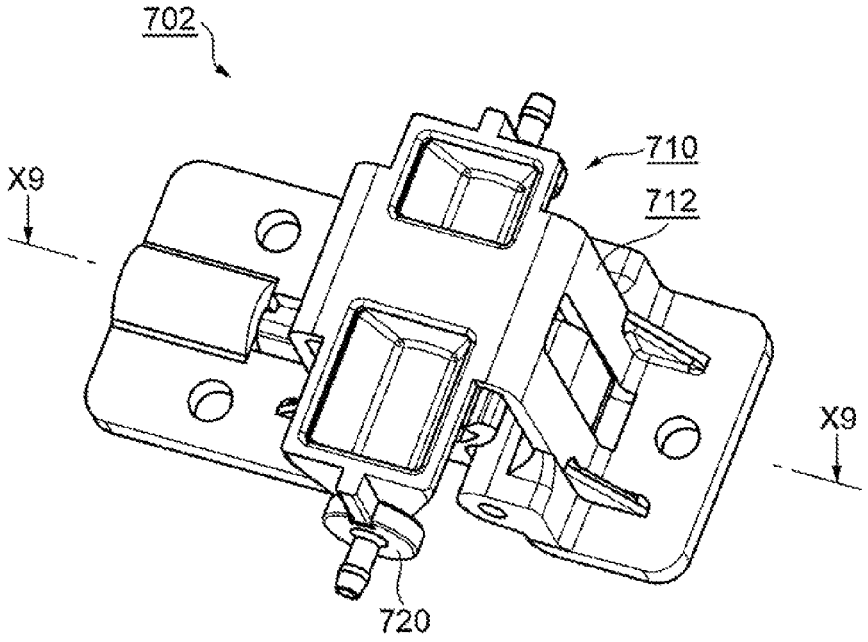
FIG. 7 is a perspective view of an optical emptiness detection unit which constitutes a principal part of the optical emptiness detection mechanism.
Figure 8:
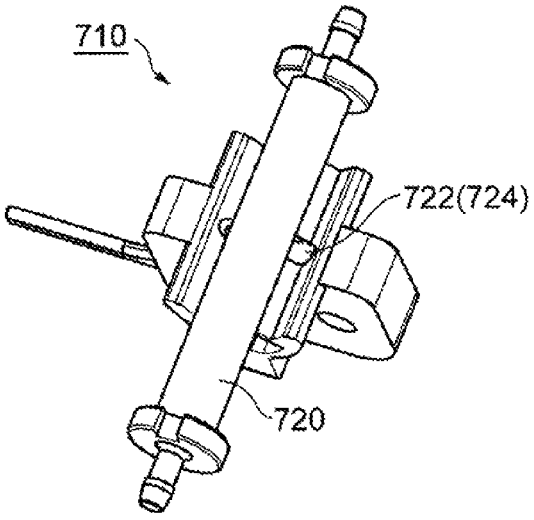
FIG. 8 is a diagram illustrating a state in which a holder is detached from the optical emptiness detection unit to expose a light transmissive tube.
Figure 9:
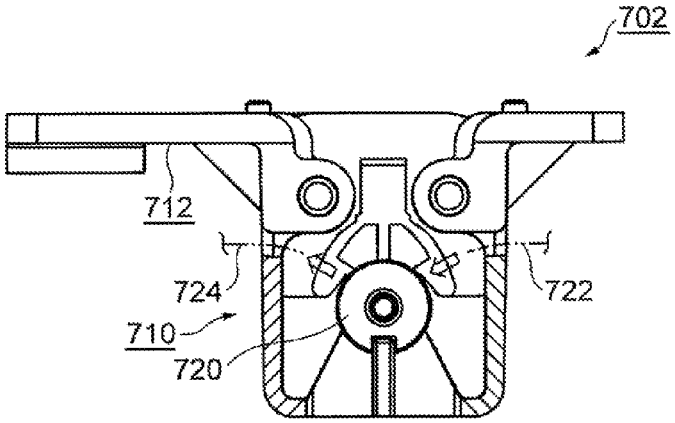
FIG. 9 is a cross-sectional view taken along line X9-X9 of FIG. 7.

FIG. 7 is a perspective view of the optical emptiness detection unit 702. The optical emptiness detection unit 702 includes a unit body 710 and a holder 712. FIG. 8 is a perspective view of the optical emptiness detection unit 702 with the holder 712 detached therefrom, that is, a perspective view of the unit body 710. FIG. 9 is a diagram taken along line X9-X9 of FIG. 7.

Referring to FIG. 8, the unit body 710 includes a light transmissive tube 720 which constitutes part of internal piping of the printer body 200, a light emitter 722, and a light receiver 724. The light transmissive tube 720 is composed of a transparent tube, typically, a glass tube or a fluororesin (PFA) tube. The light emitter 722 and the light receiver 724 are arranged to face the light transmissive tube 720 (FIG. 9). The light emitter 722 and the light receiver 724 which face the light transmissive tube 720 respectively include a light emitting unit and a light receiving unit which are mainly composed of optical fibers. A body of the light emitter 722 and a body of the light receiver 724 are each connected to a base end of the optical fibers. This type of light emitter and receiver are well known. Therefore, detailed description thereof will be omitted.

FIGS. 10A and 10B and 11A and 11B are diagrams for explaining the principle of the present invention, specifically, detection of the emptiness of the solvent cartridge 500 using light passing through the light transmissive tube 720. That is, the detection is transmission type detection.

Figure 10A:
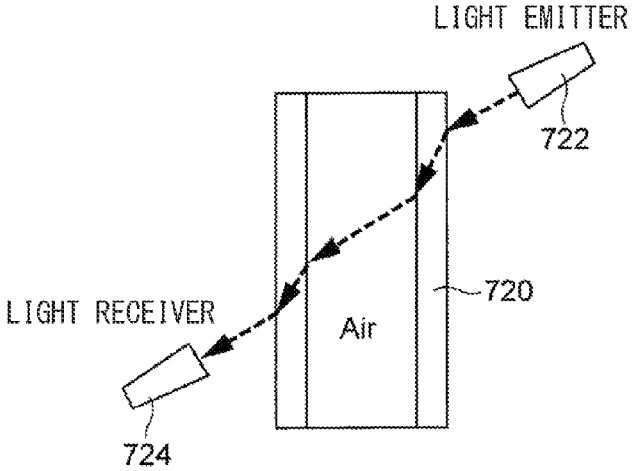
Figure 10B:
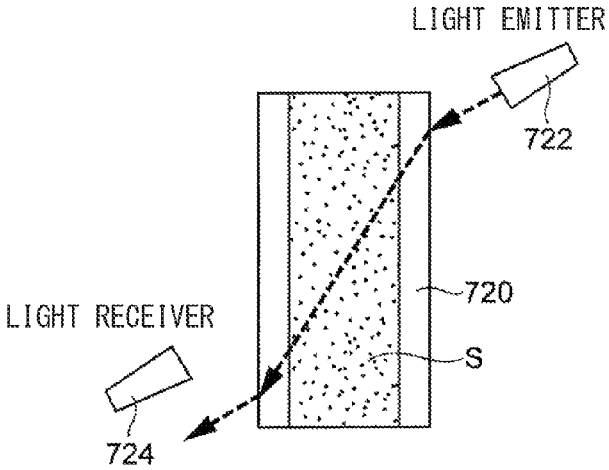
Figure 11A:
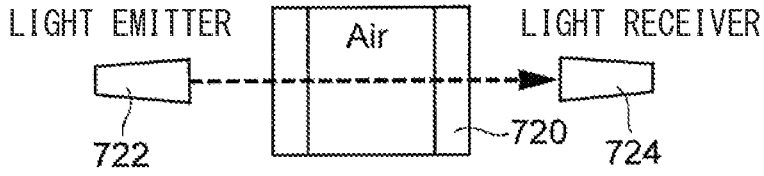
Figure 11B:
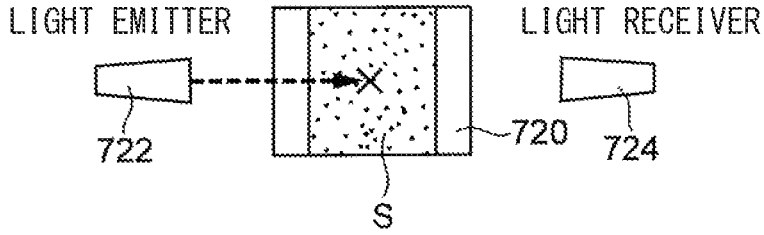
Figure 12A:
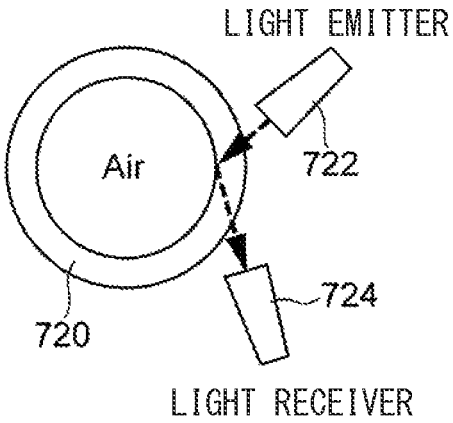
Figure 12B:
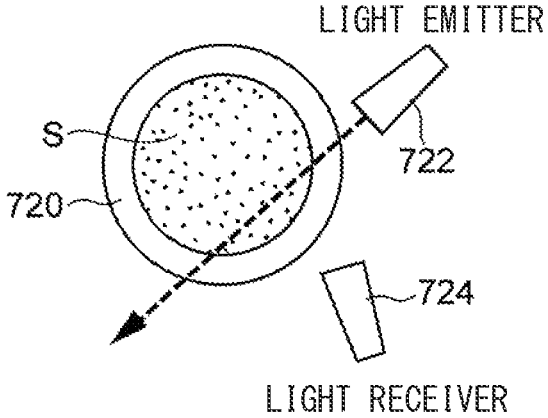

FIGS. 10A and 11A illustrate refraction of light when air is present inside the light transmissive tube 720. FIGS. 10B and 11B illustrate refraction of light when the light transmissive tube 720 is filled with the solvent S. FIGS. 12A and 12B are diagrams for explaining the principle of the present invention when a reflective light emitter and a reflective light receiver are employed. FIG. 12A illustrates refraction of light when air is present inside the light transmissive tube 720. FIG. 12B illustrates refraction of light when the light transmissive tube 720 is filled with the solvent S.

When glass is employed as the material of the light transmissive tube 720, the refractive index of glass is 1.45. On the other hand, when a fluororesin (PFA) is employed as the material of the light transmissive tube 720, the refractive index of PFA is 1.35.

Generally, methyl ethyl ketone (MEK) or ethanol is used as the solvent in the solvent cartridge 500. The refractive index of MEK is 1.38, and the refractive index of ethanol is 1.35. On the other hand, the refractive index of air is 1.0003 which largely differs from the refractive index of MEK or ethanol.

One characteristic of the present invention is to use a difference in refractive index between the solvent and air. In the example illustrated in FIGS. 10A and 10B, the inclination angles of the light emitter 722 and the light receiver 724 and the relative arrangement between the light emitter 722 and the light receiver 724 are defined so that the light receiver 724 receives light from the light emitter 722 which is arranged in an attitude inclined relative to the axis of the light transmissive tube 720 when the light transmissive tube 720 is filled with gas (typically, air) (FIG. 10A). Therefore, when the solvent S is present inside the light transmissive tube 720, it is not possible to receive light from the light emitter 722 by the light receiver 724 because of a difference in refractive index between the solvent S and air (FIG. 10B).

As described above, a predetermined amount of air is enclosed inside the solvent cartridge 500. This fact is associated with the configuration of the solvent cartridge 500 which includes the bottle 800 which is crushed to reduce the volume thereof. If the bottle 800 is a bottle whose volume is not reduced, that is, a bottle from which a solvent is taken out with the form of the bottle maintained, air is blown into the bottle when taking out the solvent. Therefore, it is not necessary to previously enclose a predetermined amount of air inside the bottle.

When the amount of solvent remaining in the bottle 800 of the solvent cartridge 500 becomes small, the bottle 800 is crushed to reduce the volume thereof. When the amount of solvent remaining in the bottle 800 becomes zero, air inside the bottle 800 enters the light transmissive tube 720. When air enters the light transmissive tube 720, light emitted from the light emitter 722 gradually starts to be received by the light receiver 724. The threshold of the light receiver 724 may be adjusted to set how much amount of light needs to be received by the light receiver 724 to reverse output of the light receiver 724. Accordingly, it is possible to directly detect the emptiness of the solvent cartridge 500.

FIGS. 10A and 10B illustrate an example in which the light emitter 722 and the light receiver 724 are arranged separately from each other in the circumferential direction of the light transmissive tube 720. However, it is needless to say that the light emitter 722 and the light receiver 724 may also be arranged separately from each other in the axial direction of the light transmissive tube 720.

In the example illustrated in FIGS. 10A and 10B, the light transmissive tube 720 may be vertically disposed, and may also be horizontally disposed. The cross-sectional shape of the light transmissive tube 720 may be any shape. The cross-sectional shape of the light transmissive tube 720 may be a circular shape, a rectangular shape, an elliptical shape, or a flat shape. As a modification, the inclination angles of the light emitter 722 and the light receiver 724 and the relative arrangement between the light emitter 722 and the light receiver 724 with respect to the axis of the light transmissive tube 720 may be defined so that the light receiver 724 receives light from the light emitter 722 when the light transmissive tube 720 is filled with the solvent.

The example illustrated in FIGS. 11A and 11B can be preferably applied to a non-transparent colored solvent. In the example illustrated in FIGS. 11A and 11B, there is used a difference in attenuation degree of light passing across the light transmissive tube 720 between when gas (typically, air) is present inside the light transmissive tube 720 and when a colored solvent is present inside the light transmissive tube 720. This is another characteristic of the present invention.

Detailed description will be made with reference to FIGS. 11A and 11B. The light emitter 722 and the light receiver 724 are arranged to face each other across the light transmissive tube 720. Further, optical axes of the light emitter 722 and the light receiver 724 are positioned so as to be perpendicular to the axis of the light transmissive tube 720. FIG. 11A illustrates a case in which air is present inside the light transmissive tube 720. In the state illustrated in FIG. 11A, light emitted from the light emitter 722 passes across the light transmissive tube 720 and is then received by the light receiver 724.

FIG. 11B illustrates a case in which a colored solvent is present inside the light transmissive tube 720. In the state illustrated in FIG. 11B, light emitted from the light emitter 722 is attenuated by the colored solvent which is present inside the light transmissive tube 720. Therefore, the amount of light received by the light receiver 724 is made zero or smaller than that in the case illustrated in FIG. 11A. The threshold of the light receiver 724 may be adjusted to set how much amount of light needs to be received by the light receiver 724 to reverse output of the light receiver 724. Accordingly, it is possible to directly detect the emptiness of the solvent cartridge 500.

FIGS. 12A and 12B are diagrams for explaining another principle of the present invention, specifically, detection of the emptiness of the solvent cartridge 500 using light reflected by the light transmissive tube 720. That is, the detection is reflection type detection. This detection method is effective when the refractive index of the material of the light transmissive tube 720 and the refractive index of the solvent are close to each other. FIG. 12A illustrates a case in which air is present inside the light transmissive tube 720. FIG. 12B illustrates a case in which the solvent is present inside the light transmissive tube 720.

In the example illustrated in FIGS. 12A and 12B, the inclination angles of the light emitter 722 and the light receiver 724 and the relative arrangement between the light emitter 722 and the light receiver 724 are defined so that, when the light transmissive tube 720 is filled with air, the light receiver 724 receives light that is emitted from the light emitter 722 and reflected by a boundary surface between the light transmissive tube 720 and the air inside thereof (FIG. 12A). Therefore, when the solvent S is present inside the light transmissive tube 720, reflection of light on a boundary surface between the light transmissive tube 720 and the solvent S inside thereof is reduced, and it is, therefore, not possible to receive light from the light emitter 722 by the light receiver 724 (FIG. 12B).

As a modification relating to the arrangement of the light emitter 722 and the light receiver 724, the inclination angles of the light emitter 722 and the light receiver 724 and the relative arrangement between the light emitter 722 and the light receiver 724 may be defined so that light emitted from the light emitter 722 is received by the light receiver 724 when the light transmissive tube 720 is filled with the solvent S.

In the present embodiment, the light transmissive tube 720 illustrated in FIG. 8 has a larger diameter than the solvent flowing tube such as the solvent replenishment tube 222 and the head cleaning tube 250 through which the solvent flows. Accordingly, the solvent can be easily accumulated inside the light transmissive tube 720. As a result, it is possible to improve the accuracy of the emptiness detection performed by the optical emptiness detection unit 702. However, the present invention is not limited to such a configuration, and a tube having a diameter equal to the diameter of the solvent flowing tube may, of course, be used as the light transmissive tube 720. Further, the "solvent flowing tube" is connected to the reservoir 600, and the solvent inside the solvent cartridge 500 attached to the reservoir 600 flows through the solvent flowing tube. The solvent flowing tube is a concept that includes the solvent replenishment tube 222 and the head cleaning tube 250. The solvent flowing through the head cleaning tube 250 is discharged from the mechanism components 302, is then collected in the gutter 304, then flows through the ink collection tube 240, and is then supplied to the main tank 202 or the conditioning tank 204.

Further, in the present embodiment, the light transmissive tube 720 is a member separated from the solvent flowing tube. Further, the light emitter 722, the light receiver 724, and the light transmissive tube 720 are unitized as the optical emptiness detection unit 702. Therefore, when there is failure in the light emitter 722 or the light receiver 724, it is possible to easily replace only the optical emptiness detection unit 702. Accordingly, the maintainability is improved. However, the present invention is not limited to such a configuration. It is needless to say that the light transmissive tube 720 and the solvent flowing tube may be composed of the same member.

Figure 13:
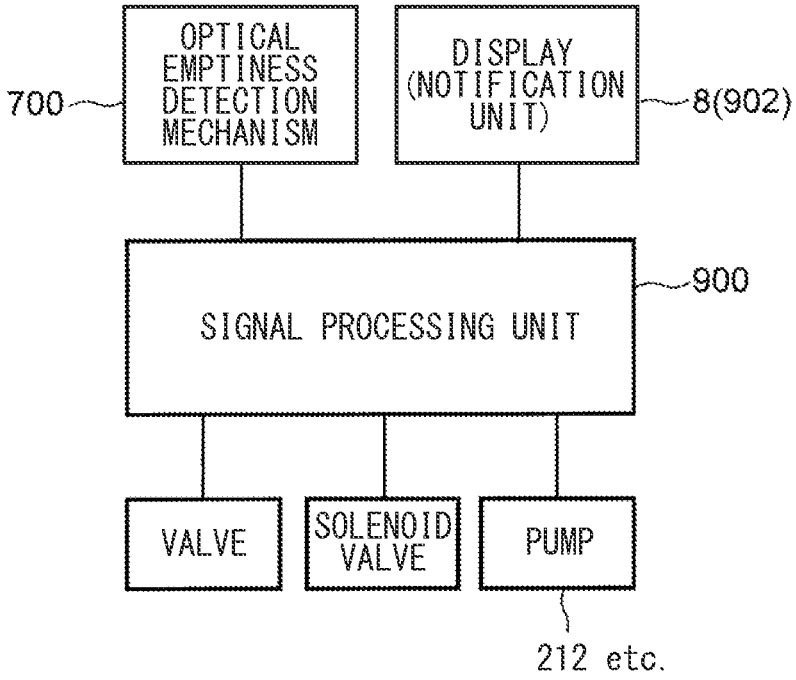
FIG. 13 is a control block diagram of the ink jet printer of the embodiment.

Emptiness Detection for Solvent Cartridge 500 (FIGS. 13 to 16):

A specific control example for detecting the emptiness of the solvent cartridge 500 by the optical emptiness detection mechanism 700 will be described. FIG. 13 is a block diagram relating to control of the ink jet printer 2. The various solenoid valves, pumps, and valves (FIG. 2) included in the ink jet printer 2 are controlled by a signal processing unit 900. As is known, the signal processing unit 900 includes a processor such as a CPU and a MPU and a memory such as a RAM and a ROM. A signal from the optical emptiness detection mechanism 700 is input to the signal processing unit 900. A display device 8 or a notification unit 902 (described later) which urges replacement of the cartridge is electrically connected to the signal processing unit 900.

Figure 14:
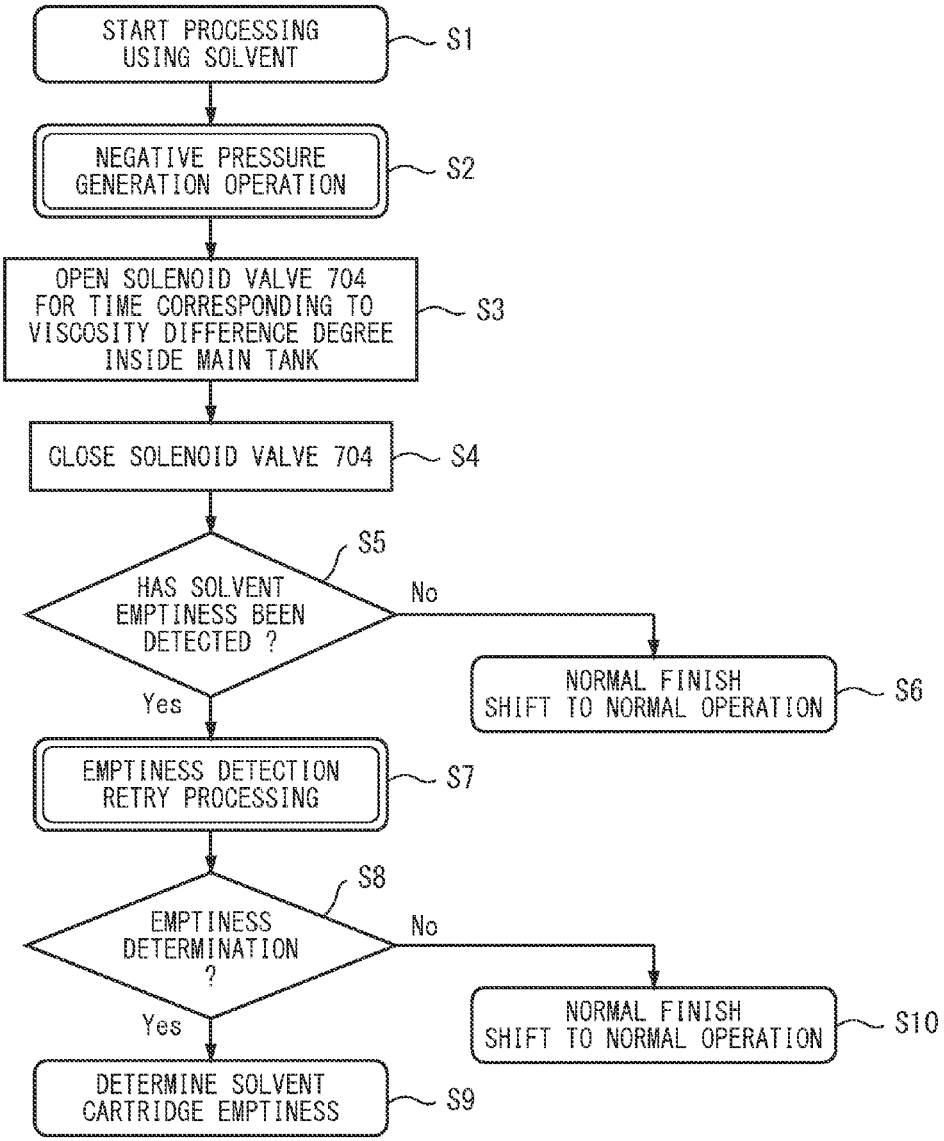
FIG. 14 is a flowchart for explaining an example of the procedure for optically detecting the emptiness of the solvent cartridge.
Figure 15:
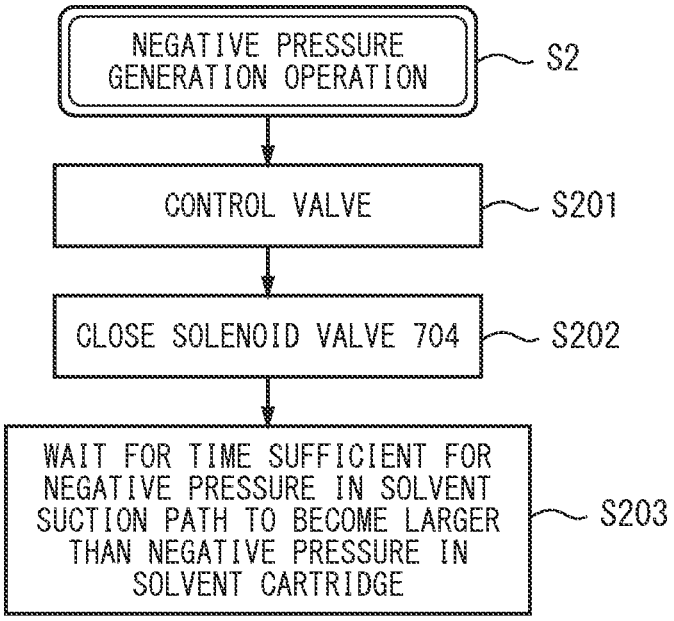
FIG. 15 is a flowchart for explaining the procedure of a negative pressure generating operation in step S2 of FIG. 14.
Figure 16:
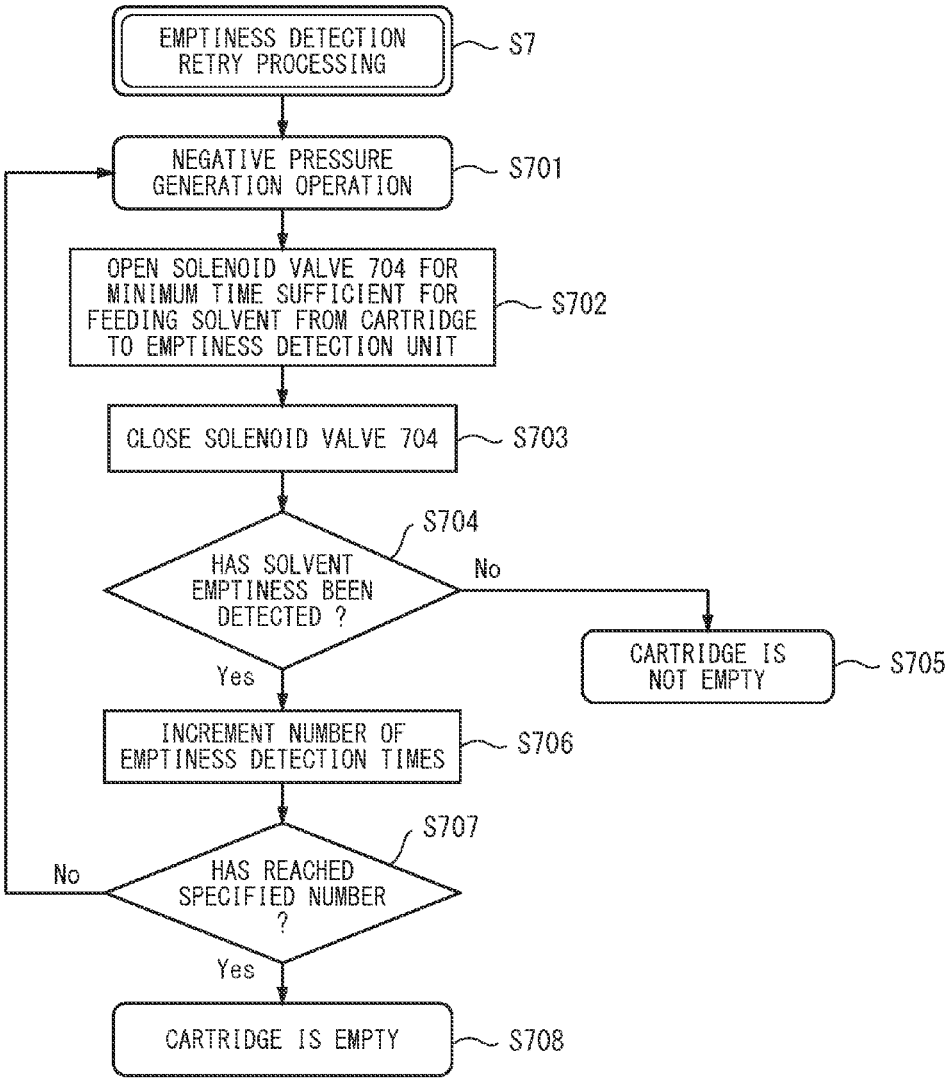
FIG. 16 is a flowchart for explaining the procedure of emptiness detection retry processing in step S7 of FIG. 14.

An example of the procedure of emptiness detection processing for determining whether the solvent in the solvent cartridge 500 has run out will be described with reference to flowcharts of FIGS. 14 to 16. FIG. 14 illustrates a main flow, and FIGS. 15 and 16 illustrate sub flows. The processing in FIGS. 14 to 16 is performed by the signal processing unit 900.

The main flow of FIG. 14 is performed when the solvent is supplied to the main tank 202 from the solvent cartridge 500 to perform adjustment of the viscosity of the ink liquid in the main tank 202. When a signal for performing the viscosity adjustment in the main tank 202 using the solvent cartridge 500 is generated (S1), an operation for generating a negative pressure inside the printer body 200, the negative pressure being larger than the negative pressure in the solvent cartridge 500, is started (negative pressure generation operation: S2).

Negative Pressure Generation Operation Processing (FIG. 15):

In step S201 of FIG. 15, the various valves of the printer body 200 are controlled to form a path for taking the solvent into the main tank 202 (FIG. 2) from the solvent cartridge 500. Then, the solenoid on-off valve 704 (FIG. 6) is closed (S202). The solenoid on-off valve 704 is continuously maintained in a closed state for a time that is sufficient for the negative pressure in a path leading from the solenoid on-off valve 704 to the circulation pump 212 to become larger than the negative pressure inside the solvent cartridge 500 by an operation of the circulation pump 212 (FIG. 2).

Emptiness Detection Processing for Solvent Cartridge 500:

Referring back to FIG. 14, the solenoid on-off valve 704 (FIG. 6) is opened in step S3. By opening the solenoid on-off valve 704, suction of the solvent from the solvent cartridge 500 is started. The solenoid on-off valve 704 is continuously maintained in an open state for a time that corresponds to the degree of the difference between the viscosity of the ink liquid inside the main tank 202 (FIG. 2) and a target viscosity. Then, when the adjustment of the viscosity of the ink liquid inside the main tank 202 has been completed, the solenoid on-off valve 704 is closed (S4).

In the next step S5, it is determined whether the optical emptiness detection mechanism 700 has detected an empty state of the solvent cartridge 500. Specifically, the determination in step S5 is performed on the basis of a signal from the light receiver 724. The "light receiving signal" from the light receiver 724 may be an analog signal indicating the amount of light received by the light receiver 724, may be an analog signal on which predetermined processing (noise removal or the like) has been performed, and may be a digitized signal. When it is determined that the amount of solvent remaining in the solvent cartridge 500 is not zero in step S5 (NO in step S5), the processing proceeds to step S6 and the emptiness detection processing is finished.

On the other hand, when it is determined that the amount of solvent remaining in the solvent cartridge 500 is zero in step S5 (YES in step S5), the next confirmation processing (emptiness detection retry processing) is performed just in case (S7).

Emptiness Detection Retry Processing (FIG. 16):

In the emptiness detection retry processing, a negative pressure generation operation is first performed (S701). That is, the solenoid on-off valve 704 (FIG. 6) is opened for a short time (S702). The time of opening the solenoid on-off valve 704 is time sufficient for introducing the solvent inside the solvent cartridge 500 into the optical emptiness detection unit 702 (light transmissive tube 720). Then, when the predetermined time has passed, the solenoid on-off valve 704 is closed (S703). Then, the processing proceeds to the next step S704 to determine whether the optical emptiness detection mechanism 700 has detected an empty state of the solvent cartridge 500. When it is determined that the amount of solvent remaining in the solvent cartridge 500 is not zero in step S704 (NO in step S704), the processing proceeds to step S705 to determine that the solvent cartridge 500 is not empty, that is, some amount of solvent remains in the solvent cartridge 500. Then, the processing proceeds to step S8 (FIG. 14) which will be described later.

On the other hand, when it is determined that the amount of solvent remaining in the solvent cartridge 500 is zero in step S704 (YES in step S704), the number of emptiness detection times is incremented in the next step S706. Then, it is determined whether the number of emptiness detection times has reached a specified number in step S707. When the number of emptiness detection times has reached the specified number, the processing proceeds to step S708 to determine that the solvent cartridge 500 is empty. Then, the processing proceeds to step S8 (FIG. 14) which will be described later.

Referring back to FIG. 14, when the emptiness detection retry processing has been completed, the processing proceeds to the next step S8 to determine the presence or absence of the emptiness detection. When a YES determination is made, it is determined that the amount of solvent remaining in the solvent cartridge 500 is zero, that is, there is no solvent remaining in the cartridge 500 in step S9, and processing corresponding to this determination is performed. Examples of the processing associated with the emptiness determination include issuing a warning for urging the replacement of the cartridge on the display device 8 and, when the solvent cartridge 500 is provided with a recording medium, writing the remaining amount "zero" in the recording medium.

When it is determined that there is a solvent remaining in the solvent cartridge 500 in step S8 (NO in step S8), the processing proceeds to step S10 and shifts to a normal operation of the printer body 200.

What is claimed is:

1. An ink jet recording apparatus, the ink jet recording apparatus being a continuous type ink jet recording apparatus that has a reservoir detachably receiving a solvent cartridge and adjusts the viscosity of an ink liquid by replenishment with a solvent from the solvent cartridge, the ink jet recording apparatus comprising:

a main tank storing an ink liquid therein;

a solvent flowing tube connected to the reservoir, the solvent flowing tube allowing a solvent in the solvent cartridge attached to the reservoir to flow therethrough;

a pump for sucking the solvent in the solvent cartridge attached to the reservoir to supply the sucked solvent to the main tank through the solvent flowing tube; and a replaceable optical emptiness detection unit disposed in the path of the solvent flowing tube, the replaceable optical emptiness detection unit including a light transmissive tube connected to the solvent flowing tube, a light emitter arranged to face the light transmissive tube, the light emitter for emitting light toward the light transmissive tube, and a light receiver for receiving light reflected by the light transmissive tube or light passing through the light transmissive tube and outputting a signal on the amount of the received light, wherein, the light transmissive tube is connected to the solvent flowing tube when the replaceable optical emptiness detection unit is disposed in the path of the solvent flowing tube, and wherein emptiness detection for the solvent cartridge attached to the reservoir is performed based on the signal output from the light receiver.

2. The ink jet recording apparatus according to claim 1, further comprising a signal processing unit electrically connected to the replaceable optical emptiness detection unit, the signal processing unit for performing the emptiness detection for the solvent cartridge attached to the reservoir on the basis of the signal output from the light receiver.

3. The ink jet recording apparatus according to claim 2, further comprising a notification unit for notifying emptiness of the solvent cartridge when the signal processing unit detects that the solvent cartridge is empty.

4. The ink jet recording apparatus according to claim 1, wherein the replaceable optical emptiness detection unit is disposed between the pump and the reservoir.

5. The ink jet recording apparatus according to claim 1, wherein the light transmissive tube and the solvent flowing tube are separate members.

6. The ink jet recording apparatus according to claim 5, wherein the light transmissive tube has a larger diameter than the solvent flowing tube.

7. The ink jet recording apparatus according to claim 1, wherein the solvent cartridge is sealed with gas previously enclosed therein, and, when the solvent in the solvent cartridge is sucked by the pump, the cartridge is crushed to reduce the volume thereof in response to the suction.

8. The ink jet recording apparatus according to claim 1, further comprising a solenoid on-off valve disposed between the light transmissive tube and the pump.

9. The ink jet recording apparatus according to claim 1, wherein the light emitter and the light receiver are arranged so that light emitted from the light emitter is received by the light receiver when a solvent is present inside the light transmissive tube.

10. The ink jet recording apparatus according to claim 1, wherein the light emitter and the light receiver are arranged so that light emitted from the light emitter is received by the light receiver when gas is present inside the light transmissive tube.

* * * * *